United States Patent [19]

Kendig

[11] 4,079,835

[45] Mar. 21, 1978

[54] ENCLOSED SHIPPING CONTAINER FOR ROLLS

[75] Inventor: Robert N. Kendig, Wilmington, Del.

[73] Assignee: ICI Americas Inc., Wilmington, Del.

[21] Appl. No.: 755,821

[22] Filed: Dec. 30, 1976

[51] Int. Cl.[2] ..... B65D 8/66

[52] U.S. Cl. ..... 206/416; 206/303; 206/408; 206/446; 206/565; 220/4 B

[58] Field of Search ..... 220/4 B, 4 E, 22.3; 206/53, 303, 389, 394, 403, 404, 405, 406, 407, 408, 416, 445, 446, 521, 565, 583

[56] References Cited

U.S. PATENT DOCUMENTS

| | | | |
|---|---|---|---|
| 823,357 | 6/1906 | Passino | 206/561 |
| 2,575,025 | 11/1951 | Mihalyi | 206/403 |
| 2,853,185 | 9/1958 | Rollie | 206/407 |
| 2,985,333 | 5/1961 | Kirkman | 220/22.3 |
| 3,294,225 | 12/1966 | Kenyon | 206/446 |
| 3,310,905 | 3/1967 | Davis et al. | 220/4 B |
| 3,360,152 | 12/1967 | Leers | 225/4 E |
| 3,656,650 | 4/1972 | Frater | 220/22.3 |
| 3,948,455 | 4/1976 | Schwartz | 206/394 |
| 3,981,400 | 9/1976 | Quintana | 206/407 |

FOREIGN PATENT DOCUMENTS

| | | | |
|---|---|---|---|
| 1,179,099 | 5/1969 | France | 220/22.3 |
| 1,153,020 | 2/1958 | France | 220/4 B |
| 922,200 | 3/1963 | United Kingdom | 220/4 E |

*Primary Examiner*—William Price
*Assistant Examiner*—Bruce H. Bernstein

[57] ABSTRACT

Enclosed shipping container assembly for an elongated article such as a roll of flexible sheet or film material. The container assembly includes a pair of open five-sided container halves of identical structure which fit together in opposite orientation to form an enclosed container, and a pair of spaced end plates inside the container for supporting a roll. The enclosed container protects the sheet or film material from dust and from accidental damage in handling. The configuration of the containers is such that a plurality of containers can be joined together to form a unitized load.

8 Claims, 5 Drawing Figures

ENCLOSED SHIPPING CONTAINER FOR ROLLS

BACKGROUND OF THE INVENTION

This invention relates to shipping containers and more particularly to shipping containers for rolls of flexible sheet or film material.

The shipment of rolls of plastic sheet and film in corrugated boxboard cartons is a widespread practice. The plastic film is wound around a thin hollow cylindrical core and is supported at its ends by a pair of end plates. The end plates are square with each side slightly longer than the outer diameter of the roll, and incorporate a plug for inserting into the core, so that the entire weight of the roll is carried by the end plates. The carton is usually square, and the length of the carton or box is equal to or greater than the length of the roll. Dunnage is used to fill the ends of the carton when the length of the carton is greater than the length of the roll being shipped. A representative roll and carton of this type are shown in U.S. Pat. No. 3,710,539. For shipping, a plurality of rolls (usually 4 to 9, depending on the size of a roll), packaged in boxboard cartons as described, are placed on a pallet. The rolls are usually stacked either 2 or 3 high, and a divider sheet, which is typically made of plywood or fiberboard, is placed between adjacent of cartons. The cartons are stacked so that the end plates are aligned. In this way the entire weight of rolls in each stack is transmitted through the end plates to the pallet. The pallet and divider sheet may have cleats to maintain the cartons in alignment. The entire pallet load is unitized in some manner such as strapping or shrink wrapping.

Packages of rolls in boxboard cartons as above have several disadvantages.

First, boxboard cartons and their contents can be damaged in various ways. There is a danger of crushing a box and damaging its contents due to shifting of a pallet load in transit. The conventional corrugated boxboard carton is not strong enough to withstand the loading imposed by the end plates of a carton stacked thereon. While the cartons are initially stacked so that the end plates of all cartons in a stack are aligned, it is difficult to maintain this precise alignment throughout shipment. The use of a divider sheet lessens but does not entirely eliminate crushing. Cartons can also be damaged by tearing due to the use of metal strapping.

Second, a plant that ships a number of widths of roll goods must either maintain an equal number of lengths of shipping cartons or use dunnage, neither of which is entirely satisfactory. The former requires a large inventory of cartons. The use of dunnage is not desirable because the dunnage may contaminate the plastic film and because the presence of end plates at positions other than the ends of the carton increases the possibility of carton failure under the end plates due to misalignment of the end plates.

Third, the conventional boxboard packaging entails the use of considerable quantities of non-reusable materials. The boxboard carton and the divider sheet are not reusable, and the pallet is frequently not returned or reused. The use of non-reusable packaging materials in quantity present a waste disposal problem and is ecologically undesirable.

Rigid shipping containers for rolls of flexible sheet material are also known. For example, U.S. Pat. No. 3,489,274 shows a rigid container for a plurality of rolls comprising a plurality of spaced rigid rectangular horizontal members and a plurality of vertical end plates (one pair for each roll) which are supported by the horizontal members. Transverse cleats at or near the ends of the horizontal members retain the end plates in place and prevent longitudinal slippage of the rolls, and longitudinal cleats prevents lateral slippage. U.S. Pat. No. 3,858,723 shows an adjustable and reusable pallet for coiled sheet metal comprising a pair of independent pallet decks, each of which has upturned side walls that are tangential to the material.

In my copending application Ser. No. 552,069, filed Feb. 4, 1975, now U.S. Pat. No. 4,042,107, issued Aug. 16, 1977, I have shown and described a returnable shipping container which is able to support a roll of any length up to slightly less than the length of the container without the use of dunnage. The container includes upper and lower rigid pallets, each of which has uniformly spaced holes arranged in a plurality of longitudinal rows, and a pair of end plate assemblies which have dowels that are received in these holes. This arrangement of holes makes it possible to place each end plate assembly in any one of a number of positions so that the distance between end plates can be varied in accordance with the length of the roll being shipped. A finite number of spacings between end plates are provided for in this manner. Each end plate assembly includes an end plate, a threaded plug or shaft, and a compression disc supported by the shaft and movable toward or away from the end plate. The discs engage the ends of the roll and hold the roll in compression. These movable discs provide an infinitely variable adjustment so that a roll of any length up to the maximum provided for can be supported. An asymmetrical pallet leg configuration permits stacking of containers one above the other. The pallets are nestable, which facilitates their return to the shipper.

The containers of either U.S. Pat. No. 3,489,274 or my copending application offer greater protection against accidental damage to rolls by bending or puncturing than that afforded by boxboard cartons. Also, the containers of either U.S. Pat. No. 3,489,274 or my copending application can be stacked vertically without damaging the rolls. However, rolls shipped in these containers are exposed to dust unless the containers are covered or wrapped (e.g., by shrink wrapping), and are subject to possible damage by the tines of a fork lift truck.

SUMMARY

The present invention provides an enclosed shipping container assembly for an elongated article, such as a roll of flexible sheet or film material, comprising an enclosed rigid container having separable upper and lower container halves of similar structure and opposite orientation which are secured together, and a pair of spaced, essentially parallel end plates in the container and supported thereby, for supporting the ends of a roll or other elongated article.

THE DRAWING

DESCRIPTION OF PREFERRED EMBODIMENT

Figure 1:
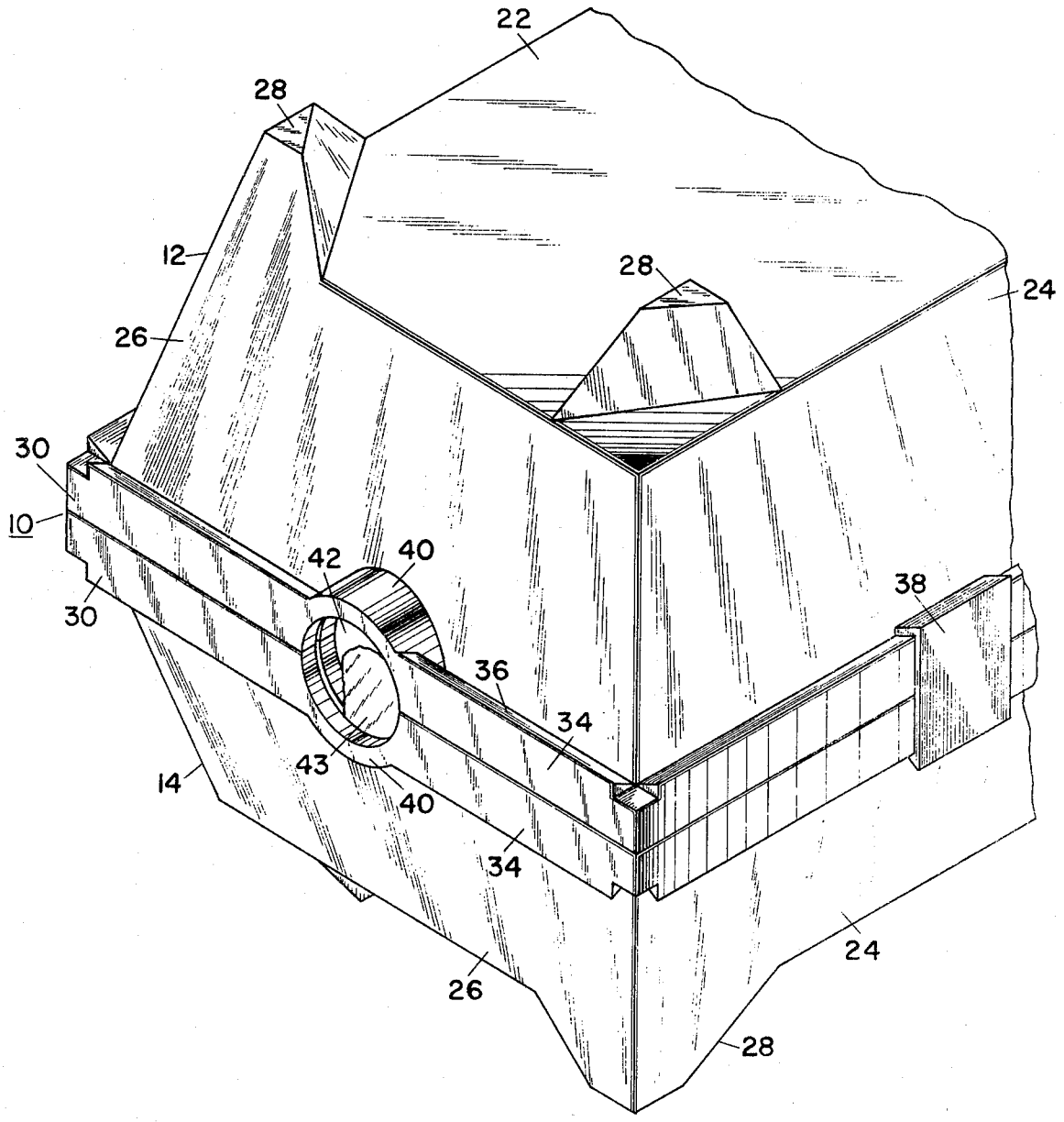
FIG. 1 is an isometric view of a shipping container assembly according to this invention, with a portion of the container assembly broken away.
Figure 2:
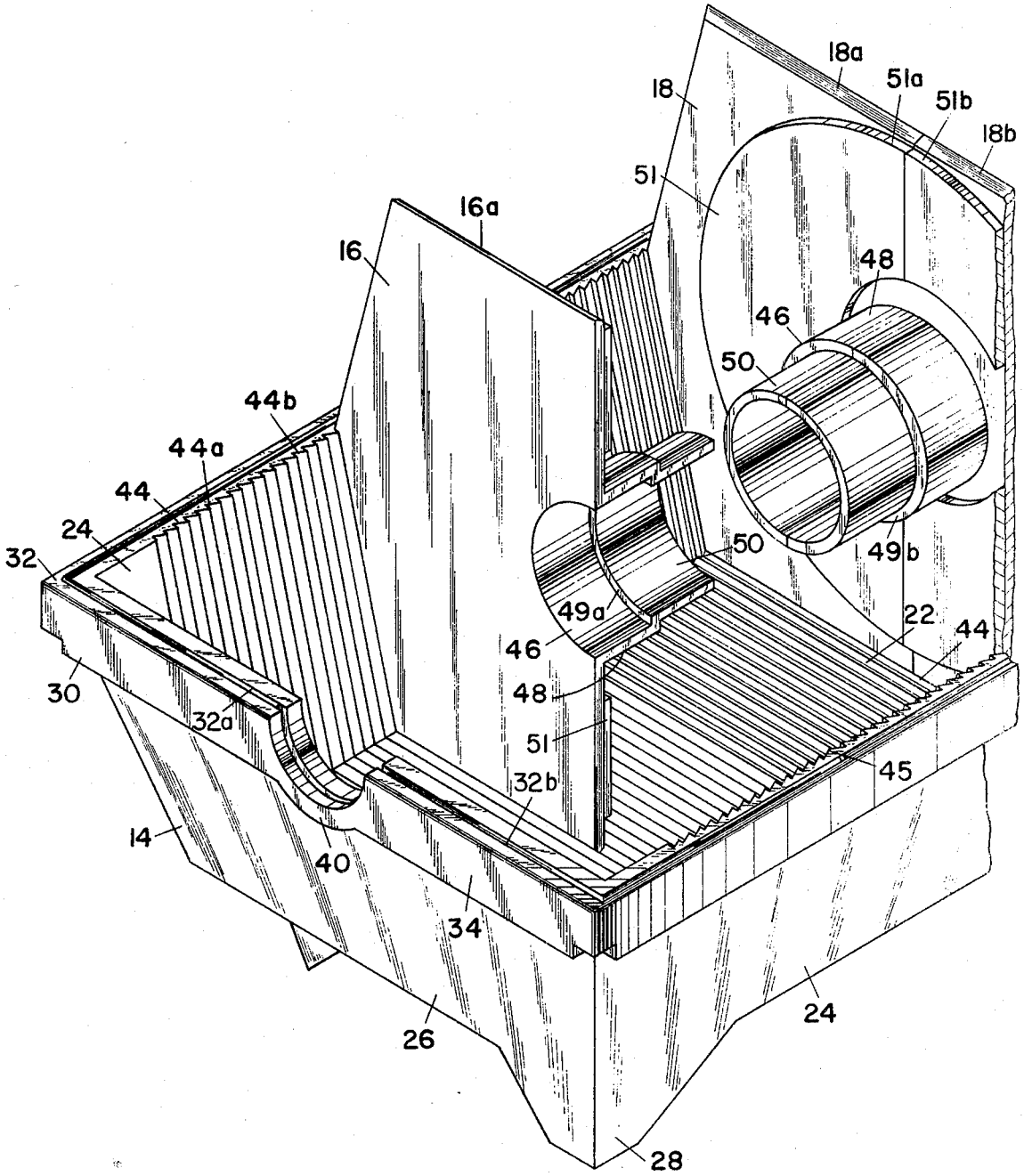
FIG. 2 is an isometric view of a container half and associated end plates according to this invention, with a portion of the container half broken away.

Referring now to FIGS. 1 and 2, the enclosed returnable shipping container assembly according to the preferred embodiment of the present invention comprises an enclosed container 10 having separable structurally similar and preferably identical but oppositely oriented essentially rigid upper and lower container halves 12 and 14, respectively, which are secured together, and a pair of spaced parallel end plates 16 and 18, each of which supports one end of an elongated article such as a roll of flexible sheet or film material, inside container 10 and supported thereby. Each container half 12 and 14 is preferably of one piece molded plastic construction, and the end plates are also preferably of molded plastic. However, the container halves and end plates may be made of wood, metal, or other rigid material if desired.

Since the container halves 12 and 14 are structurally similar and preferably identical, as shown in the drawings, only the lower container half 14 will be described in detail. The lower container half 14 is in the normal or upright orientation, and the upper container half 12 is in the inverted orientation.

Referring now to FIG. 2, lower container half 14 is an open five-sided structure comprising a horizontal and essentially planar rectangular platform or deck 22, wall means comprising a pair of opposed sloping side walls 24 and a pair of opposed sloping end walls 26 extending upwardly and outwardly from the edges of platform 22, and a plurality of legs 28 extending downwardly from the underside of platfrom 22 for supporting the container. The platform or deck 22 the bottom wall of the container half. Container half 14 is open at the top.

Only one end of each container half 12 and 14 is shown in FIG. 1, and only one end of lower container half 14 is shown in FIG. 2, since both ends are structurally identical. However, a plurality of container assemblies 10 are shown in full in FIG. 3.

The side walls 24 and end walls 26 of container half 14 are inclined outwardly as they extend upwardly from platform 22 in order to permit nesting of a plurality of container halves of like structure. This will be described in more detail with reference to FIG. 5. Both sidewalls 24 and both end walls 26 have the same height, so that their upper edges lie in a common plane.

Figure 4:
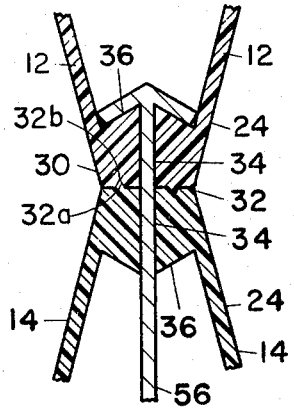
FIG. 4 is a fragmentary front sectional view of a multiple container assembly and clamp for holding the assembly together.

A rim 30 which extends around the entire perimeter of lower container half 14 is formed on the outside surfaces of the side walls 24 and end walls 26 adjacent to the upper edges thereof. Side walls 24, end walls 26, and rim 30 of lower container half 14 have a common upper edge 32 which is parallel to deck 22 and essential planar, and which provides a mating surface for engaging the corresponding surface on the upper container half 12. The surface 32 has a tongue and groove configuration in the center thereof. This tongue and groove configuration comprises alternating lengths of tongue **32*a* and groove 32*b*, each of which runs for one-fourth of the perimeter of the surface 32, from the mid-point of an end wall 26 to the mide-point of an adjacent side wall, so that no special orientation of mating container halves 12 and 14 is required. The tongue and groove joint aids in preventing dust penetration and maintains alignment between mating container halves 12 and 14. The rim 30 also has a vertical surface 34 (shown in both FIG. 1 and FIG. 2) and a lower edge 36 (best seen in FIG. 4) which extends upwardly and inwardly toward the side and end walls 24 and 26, respectively, forming an acute angle with the vertical surface 34. The lower edge 36 of rim 30 is sloped upwardly in this fashion in order to accommodate clamps 38 for securing container halves 12 and 14** together.

Rim 30 serves a threefold purpose: (1) to provide a gripping surface for clamps 38, which hold container halves 12 and 14 together (and for clamps 54, which will be described later); (2) to provide a larger area for mating surfaces 32 than the area which would be afforded by the upper edges of side walls 24 and end walls 26 in the absence of the rim 30; and (3) to provide structural reinforcement for side walls 24 and end walls 26.

Figure 3:
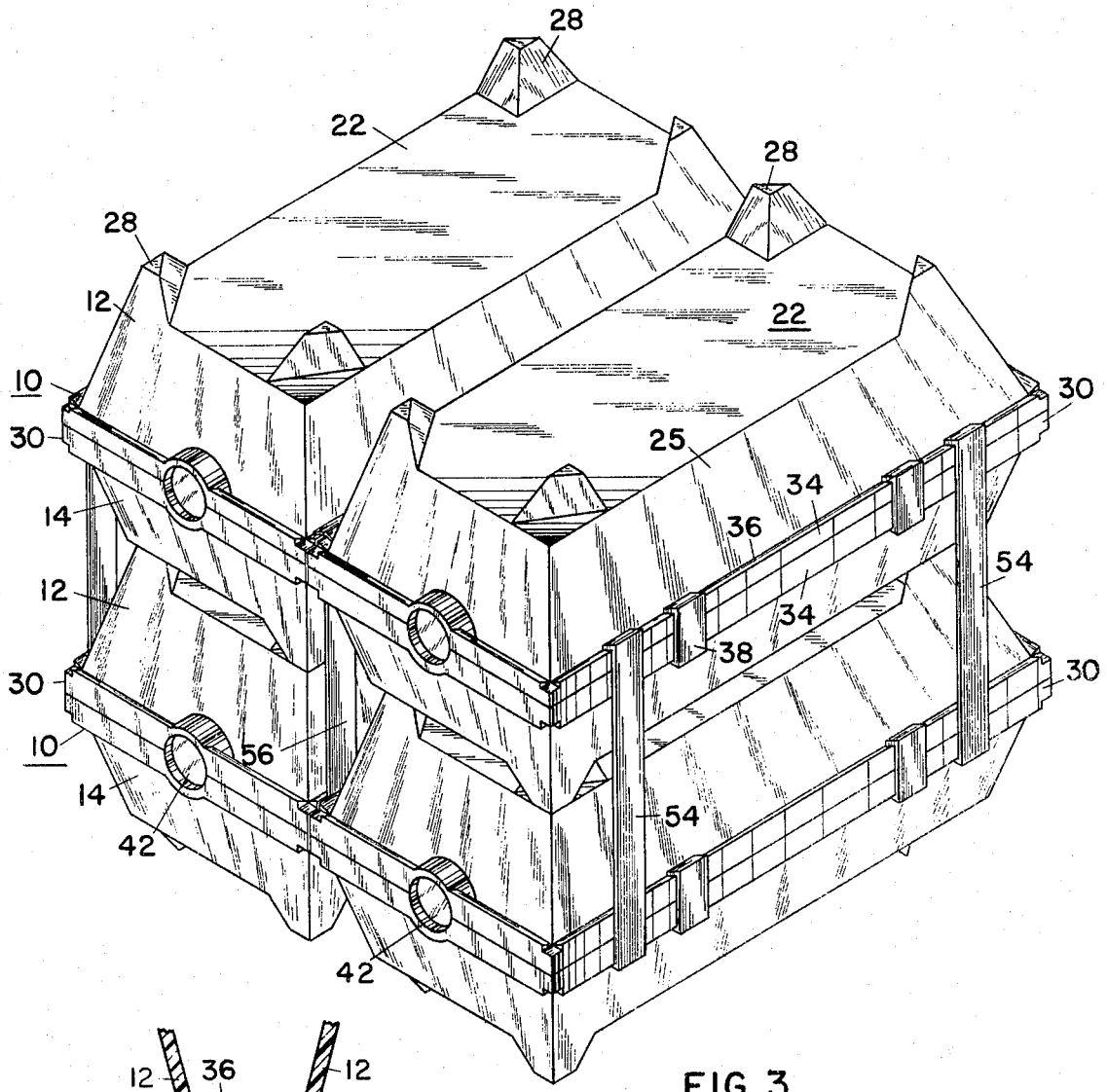
FIG. 3 is an isometric view of a multiple container assembly according to this invention.

The upper and lower container halves 12 and 14, respectively, may be held together by a plurality of clamps 38, as shown in FIGS. 1 and 3. Each clamp is generally U-shaped and has a thin flat central portion and two end portions which are disposed at an acute angle to the central portion. These two end portions engage the edges 36 of rims 30.

Each of the end walls 26, and the adjacent portion of rim 30, have a semicircular cut-out portion 40 at the midpoint of the upper edge 32, as shown in FIG. 1. These cut-out portions 40 provide two circular openings 42 in each container 10. These openings are axially aligned with the roll of sheet or film material which is contained inside the container 10. These openings permit the insertion of a probe or mandrel for the purpose of lifting a container assembly, moving it, and setting it in a desired position when the container assembly and the roll 20 contained therein reach their destination, or during loading and unloading. A thin disc 43 may be provided for each opening 42 in order to prevent dust and dirt from entering container 10.

The legs 28 are triangular in shape, tapered downwardly, and preferably hollow, and are in an asymmetrical configuration best seen in FIG. 1. This configuration permits a pair of container halves 12 and 14 to be stacked back to back (i.e., in opposite orientation) so that the legs of each container half engage the legs of the other container half so as to prevent either longitudinal or lateral slippage of either container half with respect to the other, and thereby permit stacking of two or more container assemblies of like structure one on top of the other, as shown best in FIG. 3. The leg configuration shown is the same that shown and described in applicant's Pat. No. 4,042,107.

The upper side of the platform or deck 22, and the inner surfaces of the side walls 24, of lower container half 14 have transverse serrations 44 adjacent to each end of the deck, in order to provide means for receiving the end plates 16 and 18 in spaced parallel relationship. These serrations are in two series, one on each side of the transverse center lines 45 of the platform 22 and side walls 24. The center lines 45 of the platform 22 and side walls 24 of both container halves 12 and 14 lie in a common plane, which is the transverse center plane of the container 10. One series of serrations receives end plate 16 and the other series receives end plate 18. Preferably the entire upper surface of the platform or deck 22 is serrated, so that the serrations in each series extend from one end of the platform to the transverse center line 45. The serrations in each series have alternating ridges and troughs which are formed by alternating transversely extending essentially vertical surfaces 44*a* and inclined surfaces 44*b*. The inclined surfaces 44*b* on opposite sides of center line 45 slope in opposite directions. The troughs receive the end plates 16 and 18. The vertical surfaces 44*a* in both series of serrations face toward center line 45, so as to receive compressive force from the end plates. The vertical surfaces 44*a* are uniformly spaced about ¼ inch to about ½ inch apart, which is close enough together so that a roll of any length up to the length of deck 22 can be received. Serrations 44 provide a plurality of longitudinally spaced end plate receiving means which permit the placement of each of the end plates 16 and 18 independently of the placement of the other end plate, so that the distances between the end plates can be varied in accordance with the length of the roll or other elongated article to be supported.

Container 10 also has an upper container half 12, shown in FIG. 1 but omitted in FIG. 2 for the sake of clarity. This upper container half 12 is structurally similar and preferably identical to the lower container half 14, but is oppositely oriented. Thus, the upper container half 12 has a top platform or deck 22, side walls 24 and end walls 26 which extend downwardly and outwardly from the platform 22, and legs 28 which extend upwardly from the upper side of platform 22. Serrations 44 are on the underside of deck 22.

The container assembly also includes a pair of identical spaced end plates 16 and 18 for supporting a roll (not shown) of sheet material wound around a core, or other elongated article. Each of these end plates 16 and 18 is flat and has an inwardly extending tubular plug member 46 for supporting the roll or other elongated article. The tubular plug 46 includes a first tubular porton 48 which is joined directly to the end plate, and a second tubular portion 50, which is of small diameter than the first tubular portion 48 and joined thereto. The junction between the tubular portions 48 and 50 forms an inside shoulder 49*a* and an outside shoulder 49*b*. Each of the end plates 16 and 18 consists of two identical separable end plate halves, i.e., section 16*a* and 16*b* of end plate 16, and sections 18*a* and 18*b* of end plate 18, which are disposed in side by side relationship. (Section 16*b* is omitted for the sake of clarity). These end plate sections are all identical and each comprises half of the flat end plate and a semicylindrical portion of cylinder 46. An end plate may be in the form of a single piece rather than in two sections as shown.

The edges of the end plates 16 and 18 are beveled, forming an acute angle with the outside surface of the end plate and an obtuse angle with the inside surface. The angle of inclination of this beveled edge is the same as the angle of inclination of the inclined portions 44*b* of the serrations 44.

The end plates 16 and 18 are removable and may be placed any desired distance apart, up to the maximum distance provided by serrations 44 (which is ordinarily the length of deck 22), in accordance with the length of the roll or other article to be supported. Ordinarily the end plates are placed the same distance from the respective ends of deck 22. The end plates are placed in a pair of serration troughs (one trough in each series of serrations) which are spaced apart by the desired distance. The roll exerts a compressive force against the end plates, which in turn exert compressive force against the adjacent vertical surfaces 44*a* of serrations 44. Elastic members 51 may be interposed between the end plates 16, 18 and the ends of the roll for cushioning if desired. This elastic member is a thin annular member which is made of a resilent material such as foamed polyurethane or other foamed plastic. An elastic member 51 may be in two pieces 51*a*, 51*b* which are bonded to the respective end plate halves 18*a*, 18*b* as shown. (The second elastic member 51 may similarly consist of two pieces which are bonded to end plate halves 16*a* and 16*b*). Alternatively, one piece annular members which are not bonded to the end plates may be used. These elastic members 51 provide compressible members between the roll and the end plates 16 and 18, so that the roll may be of any length up to the maximum provided for, and not necessarily a multiple of the distance between successive vertical serrations 44*a*. Both container halves 12 and 14 are load bearing members which support longitudinally directed compressive forces exerted by the roll. The lower container member 14 supports the weight of the roll as well.

A plurality of container assemblies can be unitized into a multiple container assembly as shown in FIG. 3. In this multiple container assembly, each individual container assembly 10 supports the weight of the assemblies above it. The upwardly projecting legs of the upper container half 12 of one assembly interengage with the downwardly projecting legs of the lower container half 14 of the container assembly which is directly above. As previously mentioned, the legs have an asymmetrical configuration which permits interlocking engagement so that neither lateral nor longitudinal slippage occurs. The multiple container assembly may be held together by means of long clamps 54 and 56 which extend from the rims of one container assembly to the corresponding rims rims 30 of another container assembly either directly above or directly below the first. Long clamps 54, which go along the outsides of the multiple container assembly, are like the short clamps 38 except that they have a much longer central portion. Long clamps 56 has end portions extending in both directions at each end of the central portion. The structure of these long clamps 56 and their interengagement with rims 30 may be seen most clearly in FIG. 4. All clamps are preferably metallic.

Figure 5:
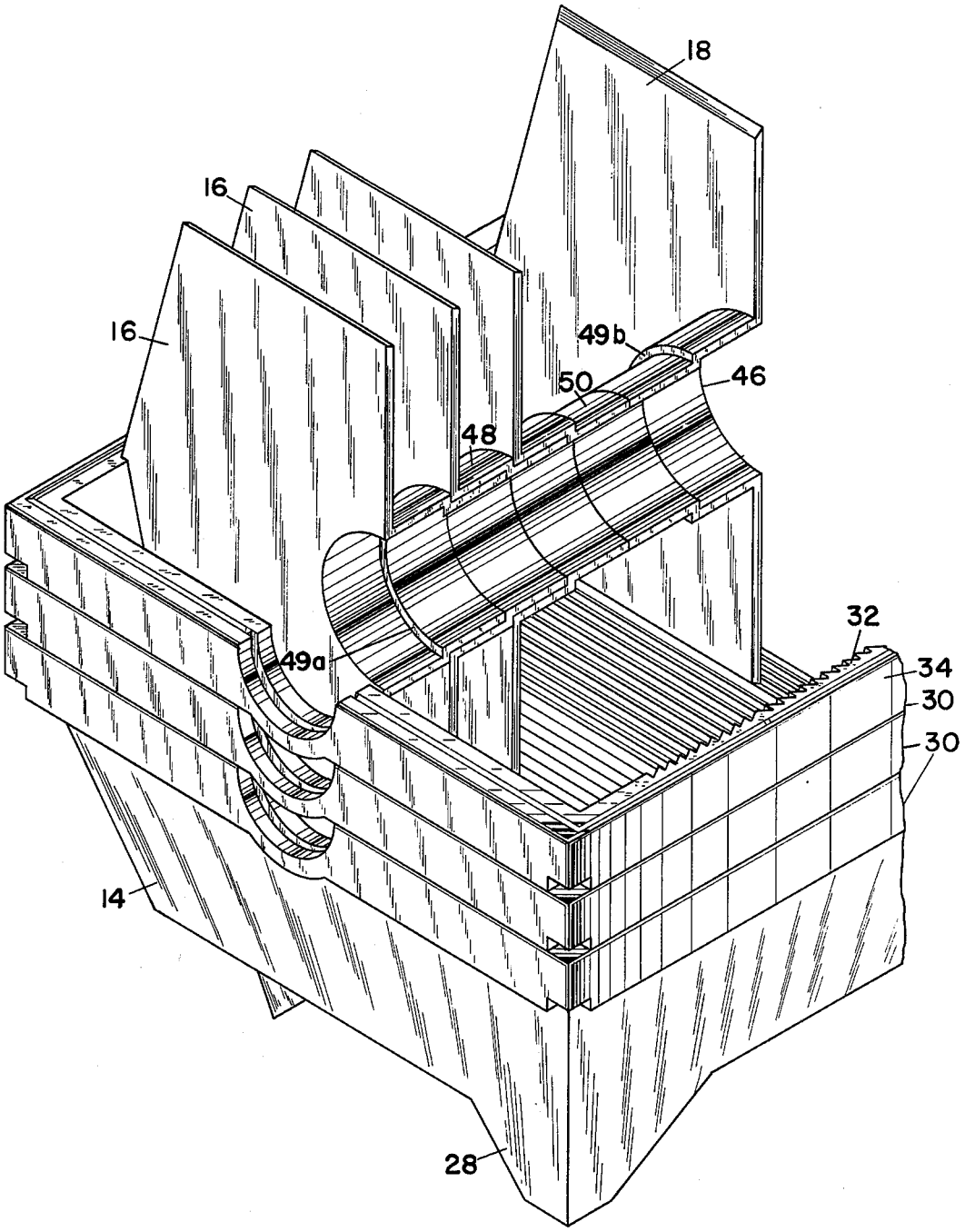
FIG. 5 is an isometric view of a plurality of stacked container halves and associated end plates for return to the shipper, with the upper halves of the shipping containers omitted for the sake of clarity.

FIG. 5 shows an assembly of container halves and end plates for return to the shipper. The return assembly illustrated has three nested inverted upper container halves 12 (not shown), three nested upright lower container halves 14, and six end plates 16 and 18 (halves of four end plates are shown), and is formed from three shipping container assemblies. The portions of the return assembly which are not shown have been omitted for the sake of clarity. The end plates may be placed close together, with the shoulder 49*b* of one end plate touching the next end plate as shown. Provision of a tubular plug 46 having portions 48 and 50 of different diameters makes it possible to place end plates closer together than would be possible if the plug 46 were of uniform diameter. Any desired number of container halves and end plates, up to the maximum number of end plates that can be accommodated, can be assembled for return in the manner shown in FIG. 5. The maximum number of end plates that can be accommodated is determined by the ratio of the length of plug member 46 to the length of deck 22. The return assembly may be unitized by long clamps 54 and 56 (shown in FIG. 3). The lengths of these long clamps and the dimensions of container halves 12 and 14 are preferably such that a return assembly of either container halves may be unitized in this manner.

In assembling a container assembly of this invention, the first step is to support the roll on a sling or a mandrel which extends through the roll core. A sling is more convenient to use and is therefore ordinarily preferred. A mandrel is preferred when handling certain materials, such as film used in graphic arts (e.g., photography), which are subject to physical damage if handled by a sling. A mandrel where used must be of greater length than the length of container 10 and of smaller diameter than the inside diameter of the smaller tubular section 50.

When a sling is used to support the roll during container assembly, the end plate halves 16*a*, 16*b*, 18*a*, and 18*b* are inserted at the ends of the roll so that the edges between adjacent end plate halves are vertical, while the roll is held with a sling. Then the subassembly consisting of the roll and end plates is lowered by the sling into a bottom container half 14 while the end plates 16 and 18 are kept either manually or mechanically in compression against the ends of the roll. Then the sling is removed and the top container half 12 is put in place.

A pair of axially movable end plugs, which in their inmost positions abut against shoulders 49*a* and extend through holes 42, may be used to keep the end plates 16 and 18 mechanically in compression. These end plugs may be cantilivered and may be supported by a load bar and hoisting arrangement.

When a mandrel is used to support the roll, end plate halves 16*a* and 18*a*, one at each end of the roll, are inserted so that the tubular section 46 of each end plate half is placed between the bottom of the mandrel and the roll core, while the free ends of the mandrel are supported by hooks, slings, or other desired means. Next, each end plate half is rotated until the tubular section 46 is wedged between the top of the mandrel and the top of the core. The two remaining end plate halves 16*b* and 18*b* are then inserted in the free space under the mandrel, and the entire assembly is rotated until the parting plane between adjacent end plate halves 16*a*, 16*b* and 18*a*, 18*b* is vertical, as shown in FIG. 2. Then the assembly consisting of mandrel, roll, and end plates is lowered into lower container half 14, with the mandrel extending through holes 42. Then the mandrel is withdrawn, the top container half 12 is placed into position, discs 43 are inserted at each end of the container, and the two container halves 12 and 14 are unitized or secured together, as for example by clamps 38 or by shrink or stretch wrapping, strapping or other means.

A container assembly according to this invention may be disassembled in the reverse order in which it is assembled.

Although the decks 22 of container halves 12 and 14 are preferably rectangular as shown, they may have other shapes if desired. For example, the end wall may be rounded or may comprise two or more faces instead of a single face if desired. It is preferable to use shapes having parallel side walls so that the illustrated end plate-receiving means may be used. The rectangular shape is preferred over other shapes because it gives the best space utilization.

The container halves 12 and 14 may have vertical side and end walls instead of the inclined side and end walls 24 and 26 if desired; however, inclined side walls are preferred in order to permit nesting.

Instead of the end plate-receiving means shown herein, the end plate-receiving means shown in U.S. Pat. No. 4,042,107 may be used. Alternatively but not preferably, transverse cleats such as those shown in U.S. Pat. No. 3,489,274, or other means which permit only one fixed distance between the end plates, can be used to hold the end plates 16 and 18 in place.

The leg configurations shown in U.S. Pat. No. 4,042,107, or other asymmetrical leg configurations which permit stacking of a pair of oppositely oriented container halves by interlocking engagement of the legs, is preferred so that container stacks in which two or more containers are stacked one on top of the other can be formed. Various such leg configurations are known in the art. However, other pallet leg or skid configurations which do not permit stacking can be used if desired.

Ordinarily both upper and lower container halves 12 and 14 are identical. This permits stacking and simplifies manufacture and assembly of containers. However, the legs can be omitted on the upper container half when it is not desired to form container stacks.

Container halves 12 and 14 can be unitized by means of shrink wrap or stretch wrap instead of the short clamp 38 as shown. Shrink wrap and stretch wrap have the further advantage of keeping out virtually all dust and dirt. While small amounts can infiltrate, especially through the holes in the end walls, of container assemblies which are not shrink or stretch wrapped, or otherwise plugged. A multiple unit container assembly as shown in FIG. 3 can be unitized by means of shrink or stretch wrap instead of by means of long clamps 54 and 56 as shown if desired.

The end plate receiving means shown herein can be applied to one surface of the deck of a pallet for roll shipping containers if desired. Specifically, one may provide a plurality of serrations as shown herein on the upper side of the lower pallet and on the underside of the upper pallet of the shipping container shown in U.S. Pat. No. 4,042,107, in place of the holes for receiving end plates shown therein. Longitudinal cleats extending along the sides of the pallet deck may be used to prevent lateral slippage of the end plates.

The shipping container assembly of the present invention has the advantage of being enclosed structure, which minimizes dust on the rolls even when shrink wrapping is not used.

The shipping container assembly of the present invention is sturdy, which minimizes the risk of damgage to the sheet or film material being shipped. The enclosed container structure of the present invention substantially lessens the danger of damage to the roll of sheet or film material by the tines of a fork lift truck, as compared either to prior art structures or to the structure in my copending application. The end plate receiving means of this invention makes it possible to place the end plates any desired distance apart in accordance with the lengths of the roll or other elongated article being shipped. The means used to achieve this end in the present invention is simpler than the means used to achieve the same end in my copending application, since the end plate structure in the present invention is simpler.

It is not necessary to set the roll on a pallet or other flat surface while assembling or disassembling a container assembly according to the present invention.

Dust and dirt contamination which would result from placing the roll on a flat surface is avoided. This especially important to plastic film.

Single container assemblies of the present invention are readily unitized into multiple container assemblies as shown in FIG. 3, for handling, storing, and shipping. This effects storage space economies and simplifies handling. Also, a plurality of container halves and end plates can be brought together into a single compact assembly for return to the shipper. This encourages the purchaser of the roll goods to return the container halves to the shipper rather than to disgard them or to use them for other purposes.

What is claimed is:

1. An enclosed rigid shipping container assembly for a roll of flexible sheet or film material or the like comprising:

(a) an enclosed container having separable essentially rigid upper and lower container halves of similar structures and opposite orientation;

(b) means for securing said container halves together;

(c) said upper container half comprising (1) a platform and (2) wall means extending downwardly and outwardly from said platform;

(d) said lower container half comprising (1) a platform, (2) wall means extending upwardly and outwardly from said platform and (3) support means extending downwardly from the underside of said platform; and (e) a pair of spaced, essentially parallel end plates in said container and supported thereby, each of said end plates having a pair of separable sections disposed in side by side relationship, the sections forming each end plate having adjacent cooperating means for supporting one end of said roll, and (f) end plate receiving means on the upper side of the lower container half and on the underside of the upper container half.

2. A shipping container assembly according to claim 1 in which said platforms are rectangular in shape and in which the wall means of each container half comprises a pair of opposed sloping side walls and a pair of opposed sloping end walls.

3. A shipping container assembly according to claim 1 in which said end plate receiving means permits each end plate to be placed in any one of a plurality of longitudinally spaced positions, whereby the distance between said end plates can be varied in accordance with the length of the elongated article to be supported.

4. A shipping container assembly according to claim 3 in which said end plate receiving means comprises first and second series of transverse serrations, the serrations in each series comprising a plurality of transversely extending and longitudinally spaced essentially vertical surfaces and inclined surfaces connecting said essentially vertical surfaces, the essentially vertical surfaces of each series facing inwardly toward the lateral center line of said platform, whereby said essentially vertical surfaces exert compressive force against said end plates.

5. A shipping container assembly according to claim 1 in which said means for supporting one end of said elongated article comprises a tubular member extending inwardly from said end plate, said tubular member having first and second portions of different diameters and a shoulder therebetween, said first portion being of greater diameter and adjacent to said end plate.

6. A shipping container assembly according to claim 1 in which said adjacent cooperating means for supporting one end of said roll are mating halves of a tubular plug member.

7. A shipping container assembly for a roll of flexible sheet or film material or the like, said container assembly comprising upper and lower horizontally disposed platforms, a pair of spaced, essentially vertical end plates extending from said upper to said lower platform, support means extending from the underside of said lower platform, and means on the underside of said upper platform and the upper side of said platform for receiving said pair of space end plates, said means for receiving said pair of spaced end plates comprising a first series of transverse serrations on one side of the transverse center line of said platform for receiving one of said end plates, and a second series of transverse serrations on the other side of said center line for receiving the other of said end plates, whereby the distance between said end plates can be varied.

8. A shipping container assembly according to claim 7, in which the serrations in each series comprise a plurality of transversely extending and longitudinally spaced essentially vertical surfaces and inclined surfaces connecting said essentially vertical surfaces, the essentially vertical surfaces of each series facing inwardly toward the lateral center line of said platform, whereby said essentially vertical surfaces exert compressive force against end plates.

* * * * *